US010952581B2

(12) United States Patent
Werius et al.

(10) Patent No.: US 10,952,581 B2
(45) Date of Patent: Mar. 23, 2021

(54) CONNECTOR PLATE FOR A VACUUM CLEANER DUST CONTAINER AND A DUST CONTAINER

(71) Applicant: Aktiebolaget Electrolux, Stockholm (SE)

(72) Inventors: Patrik Werius, Stockholm (SE); Bert Scheufen, Nümberg (SE)

(73) Assignee: Aktiebolaget Electrolux

( * ) Notice: Subject to any disclaimer, the term of this patent is extended or adjusted under 35 U.S.C. 154(b) by 222 days.

(21) Appl. No.: 16/099,094

(22) PCT Filed: May 9, 2016

(86) PCT No.: PCT/SE2016/000025
§ 371 (c)(1),
(2) Date: Nov. 5, 2018

(87) PCT Pub. No.: WO2017/196211
PCT Pub. Date: Nov. 16, 2017

(65) Prior Publication Data

US 2019/0350421 A1 Nov. 21, 2019

(51) Int. Cl.
*A47L 9/14* (2006.01)

(52) U.S. Cl.
CPC ..... *A47L 9/1445* (2013.01)

(58) Field of Classification Search
CPC ..... A47L 9/1436; A47L 9/1445
See application file for complete search history.

(56) References Cited

U.S. PATENT DOCUMENTS

| | | | |
|---|---|---|---|
| 3,209,523 | A | 10/1965 | Smithson |
| 8,424,154 | B2 | 4/2013 | Beskow et al. |
| 8,439,997 | B2 | 5/2013 | Rupp et al. |
| 8,918,953 | B2 | 12/2014 | Sjöberg et al. |

FOREIGN PATENT DOCUMENTS

| | | | |
|---|---|---|---|
| CN | 101172025 | A | 5/2008 |
| CN | 101448447 | A | 6/2009 |
| CN | 103501673 | A | 1/2014 |
| CN | 104053388 | A | 9/2014 |
| DE | 202006016789 | U1 | 12/2006 |
| DE | 202013001096 | U1 | 3/2013 |
| EP | 0362624 | A1 | 4/1990 |
| EP | 1326420 | A2 | 7/2003 |

(Continued)

OTHER PUBLICATIONS

Chinese Office Action for Chinese Application No. 201680085301.6, dated Jun. 28, 2020, with translation, 23 pages.

(Continued)

*Primary Examiner* — Robert Clemente
(74) *Attorney, Agent, or Firm* — RatnerPrestia

(57) ABSTRACT

A vacuum cleaner dust container connector plate having a front surface having an opening for an airflow, a first side surface adapted to be inserted into holder of a vacuum cleaner, a second opposite side surface, the second side surface is arranged closer to the opening than the first side surface, a third side surface connecting the first and second side surfaces, and a forth side surface connecting the first and second side surfaces. The connector plate also comprises a flexible zone arranged between the opening and the first surface.

29 Claims, 6 Drawing Sheets

(56) References Cited

FOREIGN PATENT DOCUMENTS

WO 2017196211 A1 11/2017

OTHER PUBLICATIONS

Russian Office Action for Russian Application No. 2018141785, dated Aug. 6, 2019 with translation, 9 pages.
International Search Report and Written Opinion for International Application No. PCT/SE2016/000025, dated Feb. 17, 2017—11 pages.
Russian Office Action for Russian Application No. 2018141785, dated Dec. 11, 2019 with translation, 13 pages.

CONNECTOR PLATE FOR A VACUUM CLEANER DUST CONTAINER AND A DUST CONTAINER

This application is a U.S. National Phase application of PCT International Application No. PCT/SE2016/000025, filed May 9, 2016, which is incorporated by reference herein.

The present disclosure relates to a connector plate for a vacuum cleaner dust container. A vacuum cleaner dust container comprises a dust bag made of an air permeable material and a connector plate. The connector plate is arranged to surround an opening in the dust bag and to correctly position said opening in a vacuum cleaner.

BACKGROUND

A connector plate for a vacuum cleaner dust container and a dust container are disclosed in eg. EP 1326420. The connector plate is adapted to be inserted in a holder in a vacuum cleaner and is thereby reliably positioning the dust container in the vacuum cleaner. For safety and reliability reason it is important to position the dust container correctly in the vacuum cleaner, this to avoid that dust laden airflow is entering the motor fan without the dust being separated in the dust container first.

Another aspect of the connector plate is that it should make it easy for the user to handle the dust container.

One problem associated with connector plates and dust bags of this type is how to make the connector plate and dust bag operable and easy to use with even more efficient and compact vacuum cleaners.

SUMMARY

One object of the present disclosure is therefore to provide an improved connector plate and dust container that can be more efficiently used with the vacuum cleaners and easy to use for the user.

The connector plate for a vacuum cleaner dust container may be configured so that the connector plate comprises a front surface having an opening for an airflow, a first side surface adapted to be inserted into holder of a vacuum cleaner, and a second opposite side surface. The second side surface is arranged closer to the opening than the first side surface. A third side surface is connecting the first and second side surfaces. A forth side surface is connecting the first and second side surfaces. A flexible zone is arranged between the opening and the first surface.

The connector plate may be configured to have a handle arranged on the first surface.

A tab may be arranged on the first surface. The tab extending sideways outside the first surface.

The third and fourth side both being adapted to slide in a holder (40) of a vacuum cleaner.

The flexible zone is flexible about an axis parallel to the first side surface.

The connector plate may be configured so that the opening is arranged in a first plane. Perpendicular from and along the first side surface a second plane is extending. The flexible zone is adapted to arrange the first side surface so that an alfa angel between the first plane and the second plan is more than 30 degrees, preferably more than 40 degrees, and most preferred more than 70 degrees.

The connector plate for a vacuum cleaner dust container may be configured so that the connector plate comprises, a front surface having an opening for an airflow from a vacuum cleaner. A first side surface and a second opposite side surface. The second side surface is arranged closer to the opening than the first side surface. A first normal is extending perpendicular from the first side surface and a second normal (N2) is extending perpendicular from the second side surface. In a first position of the connector plate a beta angle between the first normal and the second normal is less than 170 degrees, preferably less than 150 degrees.

Connector plate may be configured so that the beta angle between the first normal and the second normal is in the range of 170-90 degrees, preferably in the range of 150-110 degrees.

Connector plate may be configured so that in a second position if the connector plate the beta angle between the first normal and the second normal is substantially 180 degrees.

Connector plate for a vacuum cleaner dust container may be configured so that the connector plate comprises, a front surface having an opening for an airflow from a vacuum cleaner. The opening being arranged in a first plane. The connector plate also comprises, a first side surface, a second opposite side surface, a third side surface and fourth side surface connecting the first and second side surfaces. The first side surface is arranged furthest away from the opening among the first and second side surfaces. Along with and perpendicular from the first side surface a second plane is extending. The connector plate is adapted to arrange the first side surface so that an alfa angel between the first plane and the second plane is more than 30 degrees, preferably more than 40 degrees.

Connector plate may be configured so that the alfa angle between the first plane and the second plane is more than 50 degrees, preferably more than 70 degrees.

Connector plate for a vacuum cleaner dust container may be configured so that the connector plate comprising a front surface, a first side surface adapted to be inserted into holder of a vacuum cleaner, a second side surface, a third side surface connecting the first and second side surfaces, and forth side surface connecting the first and second side surfaces. The front surface comprising an opening. The second side surface is arranged closer to the opening than the first side surface. In a first position a first distance between the first side and the second side is 75-90% less than the length of the third side surface or the length of the fourth side surface.

In a second position of the connector plate a second distance between the first side surface and the second side surface is substantially the same as the length of the third side surface or the length of the fourth side surfaces.

Connector plate for a vacuum cleaner dust container may be configured so that the connector plate comprises a front surface having an opening for an airflow from a vacuum cleaner, a first side edge, and a second opposite side edge. The second side edge being arranged closer to the opening than the first side edge. A third normal extending in the direction of the front surface at the first side edge and a fourth normal extending in the direction of the front surface at the second side edge. In a first position of the connector plate a gamma angle between the third normal and the fourth normal is less than 170 degrees, preferably less than 150 degrees.

In a second position of the connector plate the gamma angle between the third normal and the fourth normal is substantially 180 degrees.

Connector plate for a vacuum cleaner dust container may be configured so that the connector plate comprises a first side surface, a second side surface, a third side surface connected to the first and second side surfaces, and a fourth side surface connected to the first and second side surfaces. The connector plate also comprises a front surface having an opening. The opening having a center. The collector plate in a first position, is arranged such that the distance between a line through the center of the opening and parallel to the second side surface or the first side surface is less than the length of the third side surface from the line to the first side surface or the length of the fourth side surface from the line to the first side surface.

The connector plate in a second position the distance between the line through the center of the opening and the first side surface is substantially the same as the length of the third side surface from the line to the first side surface or the length of the fourth side surface from the line to the first side surface.

The connector plate may be configured so that the connector plate comprises a flexible zone (7). The flexible zone is arranged between the opening and the first side surface.

The flexible zone may be configured to comprise a living hinge, a perforation, a rib structure, or a flexible material.

Connector plate may be configured so that a part of the first side surface has a sensing area adapted to interact with a sensor or safety mechanism in a vacuum cleaner.

Connector plate may be configured so that the first side surface comprises at least one hole and/or recess (15).

Connector plate may be configured so that the connector plate close to the second side surface is provided with at least one tab extending sideways outside of the side edge surface.

Connector plate may be configured so that the second side edge is arranged closer to the opening than the first side edge.

Connector plate may be configured so that the first side surface is adapted to be inserted into a dust container holder of a canister vacuum cleaner.

Connector plate may be configured so that the connector plate comprises a closing mechanism adapted to be able to close the opening, the closing mechanism preferable comprises a slidable shutter, a lid or a hatch.

Connector plate may be configured so that the connector plate is mainly or wholly made of plastic, preferably polypropylene, paper, preferably cardboard, metal, or a wood-based material.

Connector plate may be configured so that the connector plate is mainly man of paper, preferably cardboard, wherein the flexible zone comprises one or more perforations or holes substantially parallel to the second side surface.

Dust container for a vacuum cleaner may be configured so that the dust container comprises an air permeable bag having a bag opening, and a connector plate. The connector plate is attached to the bag so that the bag opening and the opening of the connector plate coincide.

DETAILED DESCRIPTION

Figure 1:
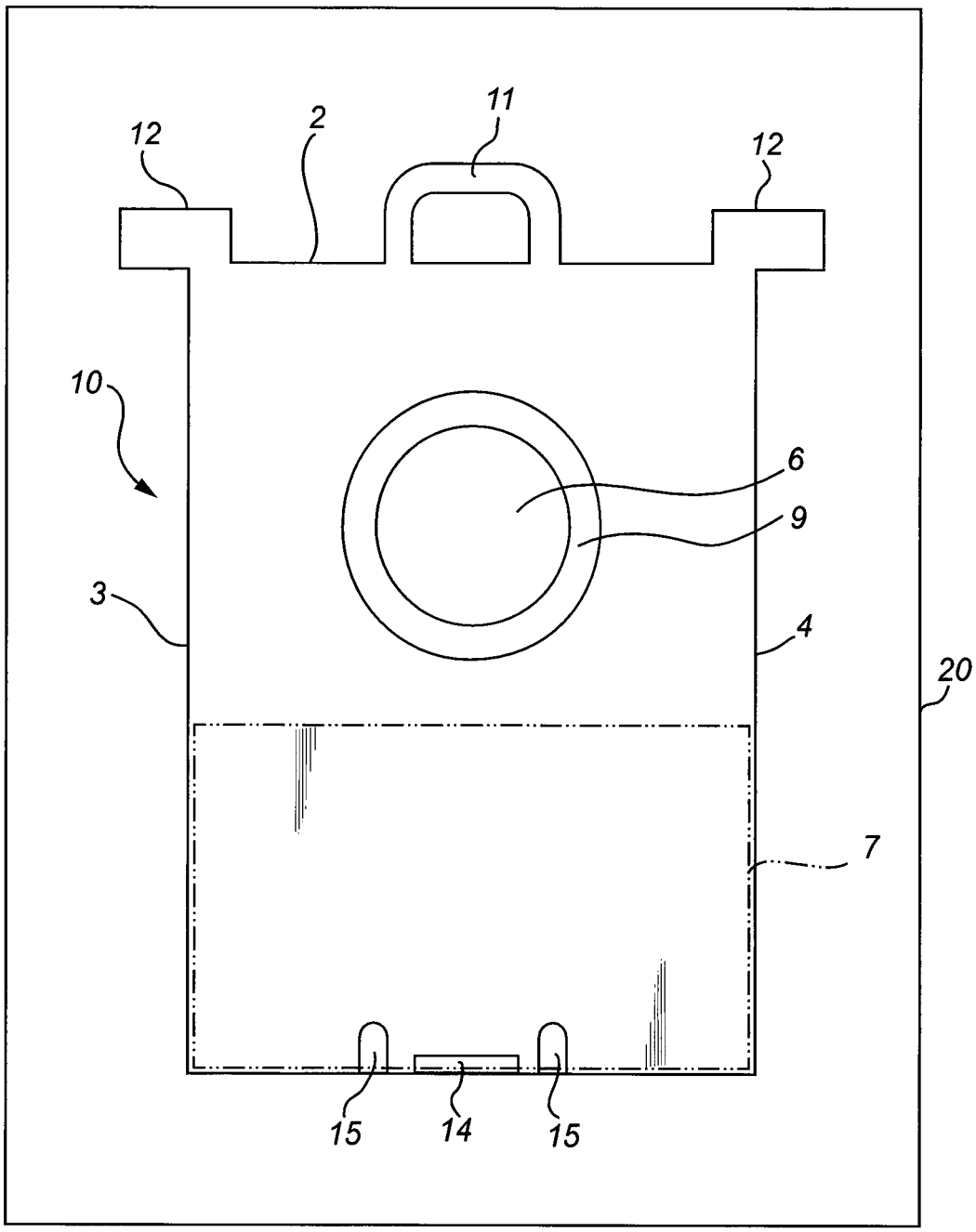
FIG. 1 shows a dust container for a vacuum cleaner.
Figure 2:
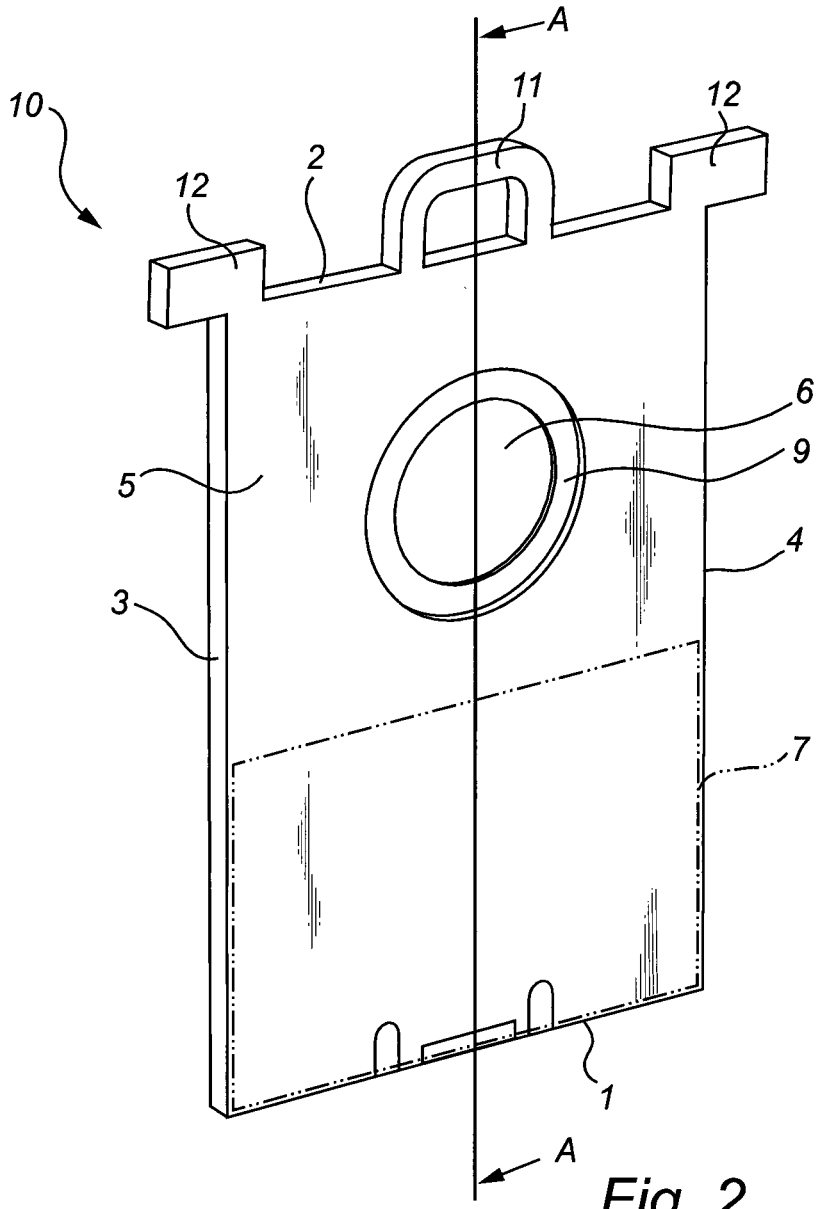
FIG. 2 shows a connector plate for a dust container.

The present disclosure relates to a connector plate and a dust container for a vacuum cleaner, as illustrated in FIG. 1. FIG. 1 shows a connector plate (10) for a vacuum cleaner dust container (30). The connector plate (10) comprises a front surface (5) having an opening (6) for an airflow form a vacuum cleaner, preferably a canister vacuum cleaner. The connector plate also comprises a first side surface (1) adapted to be inserted into holder of a vacuum cleaner and a second opposite side surface (2). The second side surface (2) is arranged closer to the opening (6) than the first side surface (1). A third side surface (3) is connecting the first and second side surfaces, and a forth side surface (4) is also connecting the first and second side surfaces. The connector plate (10) also comprises a flexible zone (7) arranged between the opening (6) and the first surface (1).

The connector plate has a handle (11) arranged on the first surface (1). The handle (11) is intended to be used by a user when the connector plate and dust container is to be removed from the holder.

The connector plate also has a tab (12) arranged on the first surface (1). The tab (12) is extending sideways outside the first surface for stopping the connector plate for being inserted too much in the holder. It is possible to have one tab on either side or two tabs on opposite sides, as shown in FIG. 1

The third and fourth side surfaces are both being adapted to slide in the holder (40). The holder typically comprises a curved or step-wise curved track into which the third and fourth side surfaces slides.

The flexible zone (7) is flexible about an axis parallel to the first side surface. The flexible zone makes it possible for the connector plate to follow the curved or step-wise curved track of the holder (40).

Figure 3:
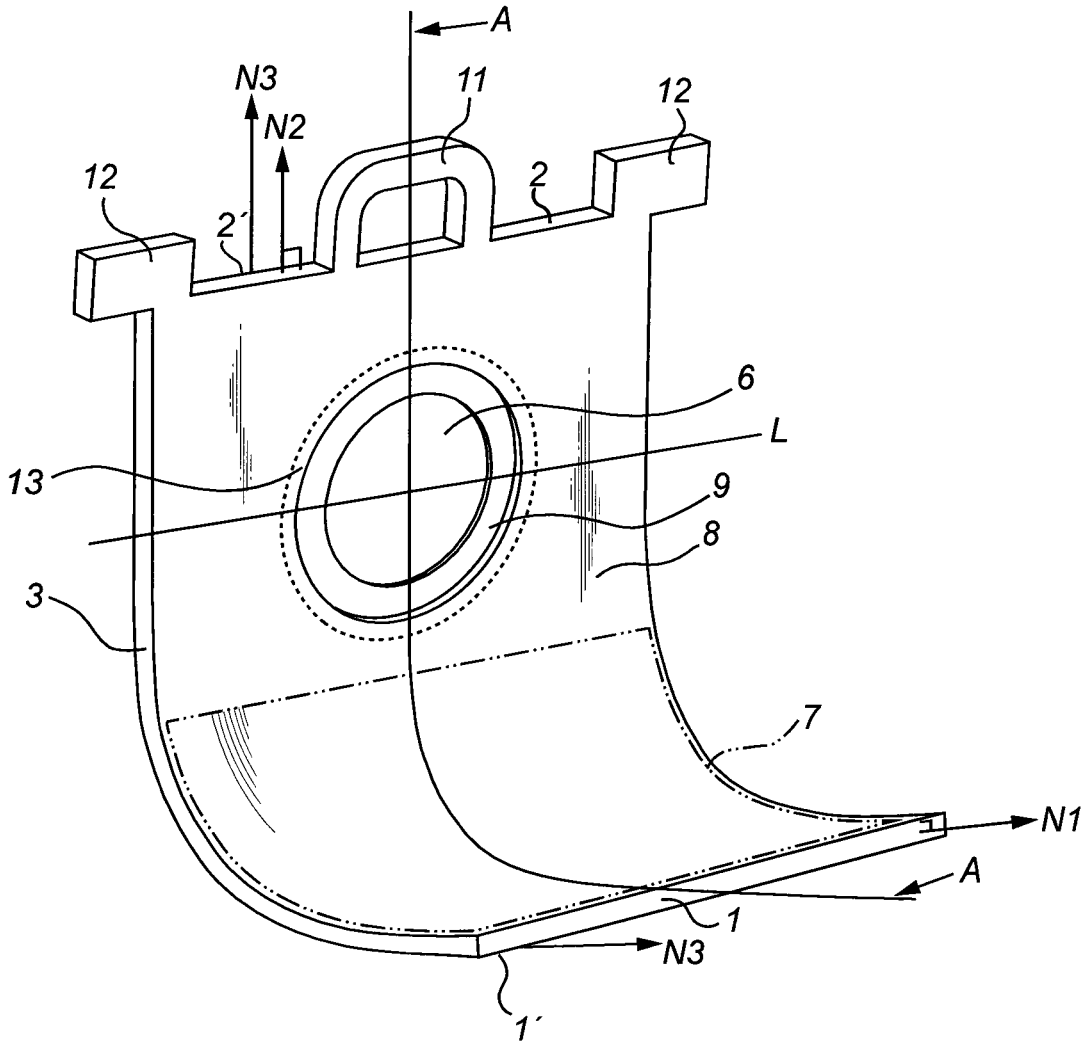
FIG. 3 shows a perspective view of a connector plate, where an extending portion is bent out of the plane of a central portion.
Figure 4:
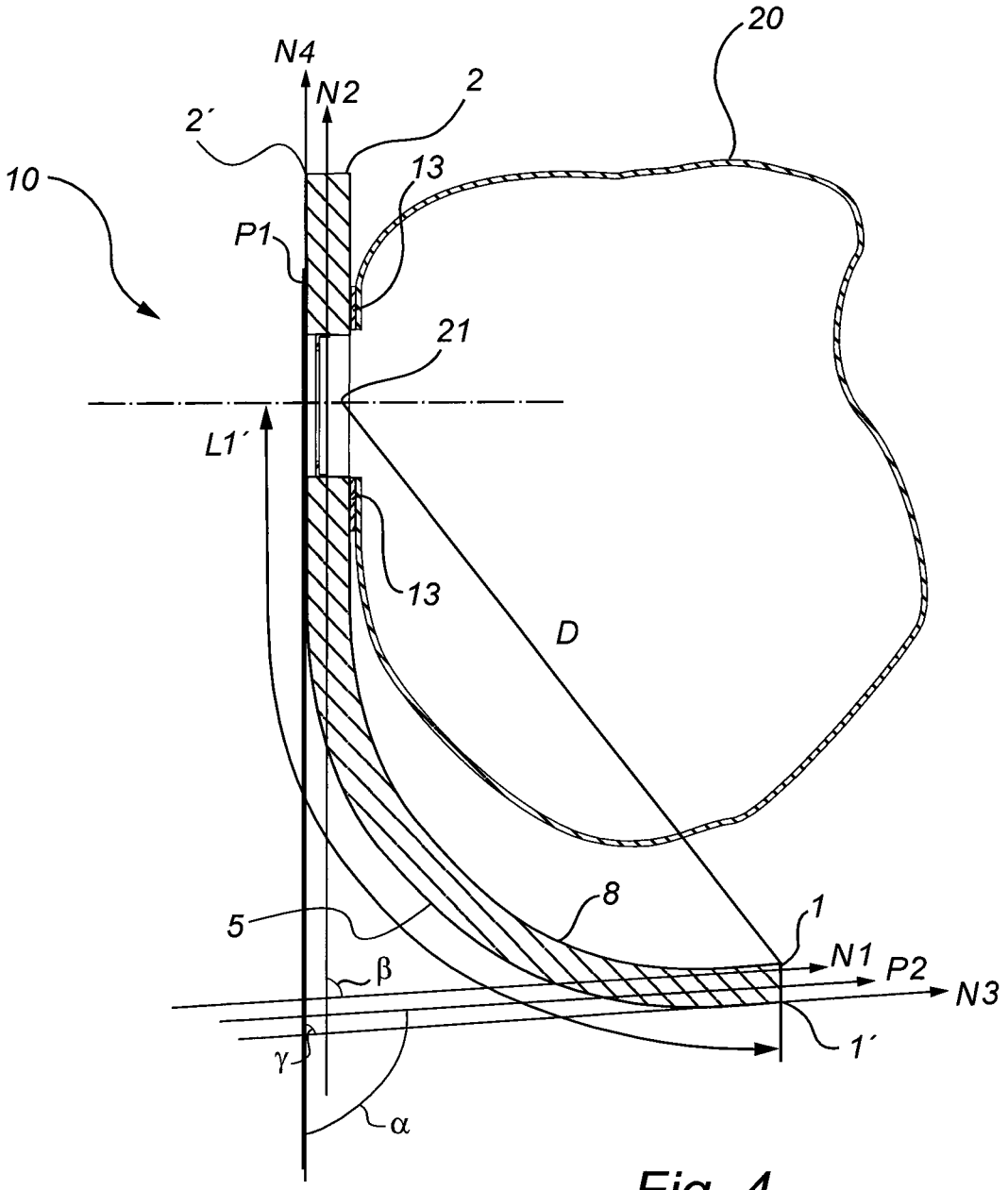
FIG. 4 shows a cross section along AA in FIG. 3
Figure 4A:
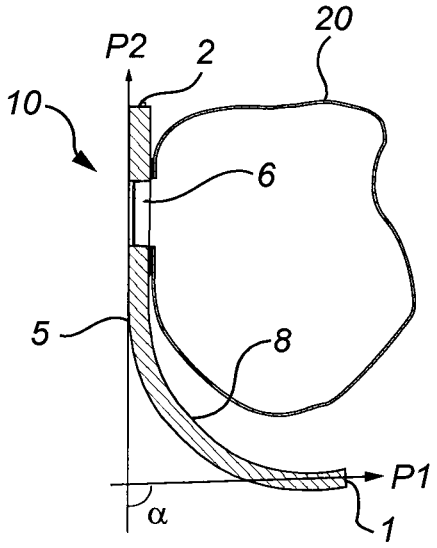
FIG. 4*a-c* show a cross section along AA in FIG. 3
Figure 4B:
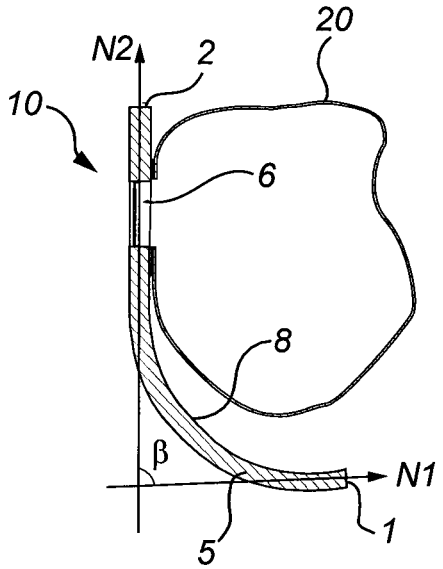
Figure 4C:
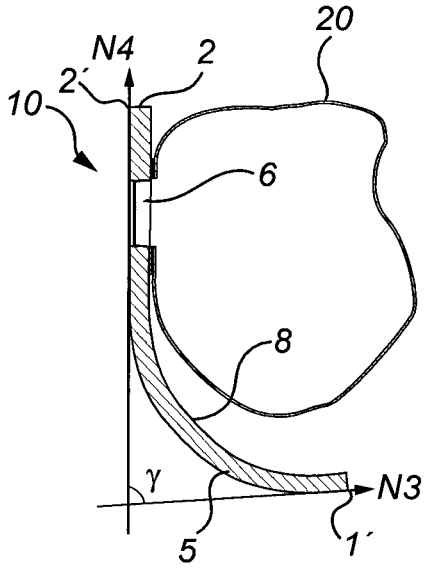
Figure 5:
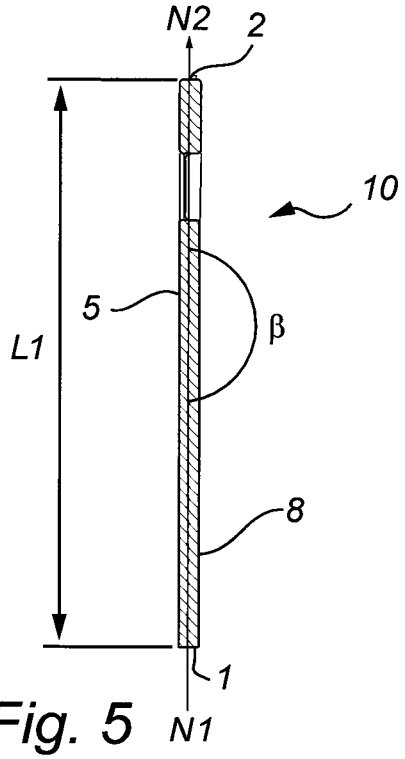
FIG. 5 shows a cross section along AA in FIG. 2
Figure 6:
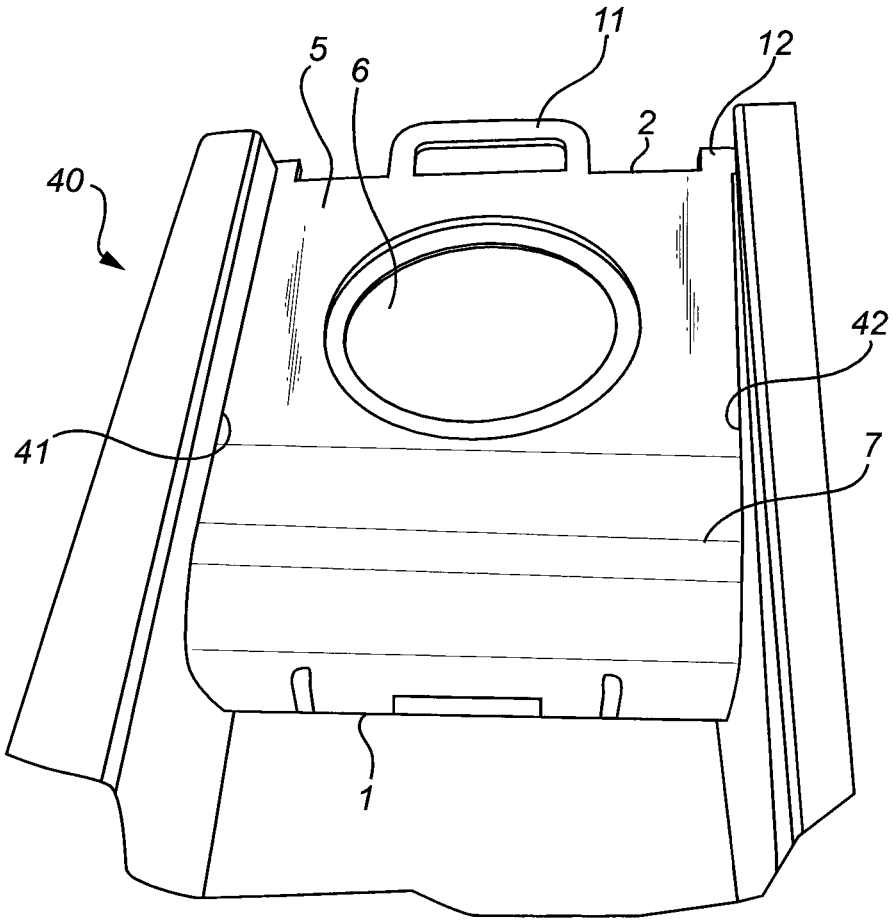
FIG. 6 shows a connector plate inserted into a holder of a vacuum cleaner

FIG. 3 shows a connector plate having the opening (6) arranged in a first plane (P1) which is extending perpendicular from and along the first side surface a second plane (P2). The flexible zone (7) is adapted to arrange the first side surface (1) so that an alfa angel (a) between the first plane (P1) and the second plan (P2) is more than 30 degrees. Preferably the alfa angle is more than 40 degrees, or most preferred more than 70 degrees.

FIG. 3 shows a connector plate (10) for a vacuum cleaner dust container (30). The connector plate (10) comprises, a front surface (5) having an opening (6) for an airflow (F) from a vacuum cleaner, a first side surface (1), and a second opposite side surface (2). The second side surface (2) is arranged closer to the opening (6) than the first side surface (1). A first normal (N1) is extending perpendicular from the first side surface (1) and a second normal (N2) is extending perpendicular from the second side surface (2). In a first position a beta angle (β) between the first normal (N1) and the second normal (N2) is less than 170 degrees, preferably less than 150 degrees.

The beta angle is preferably in the range of 170-90 degrees, and most preferably in the range of 150-110 degrees.

In a second position of the connector plate the beta angle (β) between the first normal (N1) and the second normal (N2) is substantially 180 degrees.

The Figures shows a connector plate (10) for a vacuum cleaner dust container (30). The connector plate (10) comprises, a front surface (5) having an opening (6) for an airflow (F) from a vacuum cleaner. The opening (6) being arranged in a first plane (P1), the connector plate also comprises, a first side surface (1), a second opposite side surface (2), a third side surface (3) and fourth side surface (4) connecting the first and second side surfaces. The first side surface (1) is arranged furthest away from the opening (6) among the first and second side surfaces. Along with and perpendicular from the first side surface (1) a second plane (P2) is extending. The connector plate (10) is adapted to arrange the first side surface (1) so that an alfa angel (a) between the first plane (P1) and the second plane (P2) is more than 30 degrees, preferably more than 40 degrees. The connector plate may alternatively be arranged so the alfa angle (a) is more than 50 degrees, preferably more than 70 degrees.

FIG. 3 shows a connector plate (10) for a vacuum cleaner dust container (30). The connector plate (10) comprises a front surface (5), a first side surface (1) adapted to be inserted into holder (40) of a vacuum cleaner, a second side surface (2), a third side surface (3) connecting the first and second side surfaces, and forth side surface (4) connecting the first and second side surfaces. The front surface (5) comprises an opening (6) for an air flow (F) from a vacuum cleaner. The second side surface (2) is arranged closer to the opening (6) than the first side surface (1). In a first position of the connector plate a first distance (D1) between the first side (1) and the second side is 75-90% less than the length of the third side surface (L1) or the length of the fourth side surface (L2).

In a second position of the connector plate a second distance (D2) between the first side surface (1) and the second side surface (2) is substantially the same as the length of the third side surface (L1) or the length of the fourth side surfaces (L2).

FIG. 3 shows a connector plate (10) for a vacuum cleaner dust container (30). The connector plate (10) comprises, a front surface (5) having an opening (6) for an airflow (F) from a vacuum cleaner, a first side edge (1'), a second opposite side edge (2'), the second side edge (2') being arranged closer to the opening (6) than the first side edge (1'). A third normal (N3) is extending in the direction of the front surface at the first side edge. A fourth normal (N4) is extending in the direction of the front surface at the second side edge. In a first position a gamma angle (γ) between the third normal (N3) and the fourth normal (N4) is less than 170 degrees, preferably less than 150 degrees.

In a second position of the connector plate the gamma angle (γ) between the third normal (N3) and the fourth normal (N4) is substantially 180 degrees.

FIG. 3 shows a connector plate (10) for a vacuum cleaner dust container. The connector plate (10) comprises a first side surface (1), a second side surface (2), a third side surface (3) connected to the first and second side surfaces, and a fourth side surface (4) connected to the first and second side surfaces. The connector plate also comprises a front surface (5) having an opening (6) for an air flow of a vacuum cleaner. Said opening (6) have a center.

The collector plate (10) in a first position, is arranged such that the distance (D) between a line (L) through the center of the opening and parallel to the second side surface (2) or the first side surface (1) is less than the length of the third side surface from the line to the first side surface (L1') or the length of the fourth side surface from the line to the first side surface (L2'). In a second position of the connector plate the distance (D) between the line through the center of the opening and the first side surface is substantially the same as the length of the third side surface from the line to the first side surface (L1') or the length of the fourth side surface from the line to the first side surface (L2').

The connector plate shown in the Figures has a gasket (9) around the opening (6) so as to provide a sealing function, reducing leaks in the flow from an inlet hose to the dust bag. The connector plate has a flexible zone (7) arranged between the opening (6) and the first side surface (1). The flexible zone (7) may comprise a living hinge, a perforation, a rib structure, or a flexible material.

While the flexible zone (7) make it easy to bend a part of the connector plate, it is still desired that the connector plate remains substantially flat during production and/or during transportation and handling. That is, until the dust container is to be used, it is preferred that the connector remains in the flat shape illustrated in FIG. 1. This makes it easier for instance to attach the connector plate 3 to the dust bag 5 in an efficient automated process. This may be achieved by a flexible zone that requires some force to be flexible, like living hinge, a perforation, a rib structure or a flexible material.

A part of the first side surface (1) has a sensing area (14) adapted to interact with a sensor or safety mechanism in a vacuum cleaner.

The first side surface (1) comprises at least one hole and/or recess (15). The hole or recess is adapted to lock the connector plate in that holder so that some force is required to remove the connector plate and dust bag from the holder.

Close to the second side surface (2) the connector plate is provided with at least one tab (12) extending sideways outside of the side edge surface.

As can be seen in the Figures the second side edge (2') is arranged closer to the opening (6) than the first side edge (1').

The first side surface (1) is adapted to be inserted into the dust container holder of the canister vacuum cleaner.

The connector plate may also comprise a closing mechanism (not shown) adapted to be able to close the opening (6). The opening (6) is preferably closed before the user remove the dust container form the vacuum cleaner to avoid that dust falls out during the removal and disposal of the dust container. The closing mechanism may be a slidable shutter, a lid or a hatch.

The connector plate (10) is mainly or wholly made of a plastic material, preferably Polypropylene, PP, and/or polyethylene, PE, paper, preferably cardboard, metal, or a wood-based material.

In one embodiment the connector plate is mainly man of paper, preferably cardboard. The flexible zone comprises one or more perforations or holes substantially parallel to the second side surface.

In one embodiment a dust container (30) for a vacuum cleaner comprises an air permeable bag (20) and a connector plate. The bag having a bag opening (21). The connector plate (10) is attached to the bag (20), preferably by gluing, so that the bag opening (21) and the opening (6) of the connector plate coincide.

The disclosure shows that the connector plate can easily be inserted into a holder where the inner part of the holder, that takes up the connector plate's flexible zone (7), can be curved. The insertion into the holder forces the flexible zone (7) to be bent. Thereby the holder can better use the available space inside a vacuum cleaner canister, which may have a curved inner wall. The holder may closely follow the inner wall, such that the dust bag may be allowed to expand to a greater extent, thereby increasing the available dust bag volume. The whole length of the connector plate may still contribute in keeping the dust bag safely in the correct position.

In general, a greater freedom to locate the end of the holder where desired is obtained. In one example, a mechanical function may be provided in the holder end, verifying that a bag is correctly installed and prohibiting closing of a canister hatch unless a bag is provided. Using a curved holder, allows this function to be located at a number of positions along the canister periphery.

LIST OF FEATURES

1. First side surface
2. Second side surface
3. Third side surface
4. Fourth side surface
5. Front surface
6. Opening
7. Flexible zone
8. Rear surface
9. Gasket
10. Connector plate
11. Handle
12. Tab
13. Area for fastening dust bag
14. Sensing area
15. Hole/recess
1' First side surface edge
2' Second side surface edge
20. Dust bag
21. Bag opening
30 Dust container
40 Holder for a vacuum cleaner dust container
41 Track
42 Track
N1 First normal extending perpendicular from first surface
N2 Second normal extending perpendicular from second surface
N3 Third normal
N4 Fourth normal
P1 Plane which the opening is arranged
P2 Plane extending perpendicular form and along first side surface
α Alfa angel between P1 and P2
β Beta angel between N1 and N2
γ Gamma angel between N3 and N4
L1 Length of the third side surface
L2 Length of the fourth side surface
F Airflow
L1 Length of third side surface
to L2 Length of forth side surface
D Distance
L1' Length of third side surface from the center of the opening to the first side surface
L2' Length of forth side surface from the center of the opening to the first side surface

The invention claimed is:

1. A connector plate for a vacuum cleaner dust container, the connector plate comprising:

a front surface having an opening for an airflow;

a first side surface configured to be inserted into a holder of a vacuum cleaner;

a second side surface located opposite the first side surface, the second side surface being closer to the opening than the first side surface;

a third side surface connecting the first and second side surfaces;

a fourth side surface opposite the third side surface and connecting the first and second side surfaces;

a flexible zone between the opening and the first side surface; and an opening zone between the flexible zone and the second side surface and including the opening therein;

wherein the flexible zone is more flexible than the opening zone; and wherein the flexible zone comprises one or more perforations or holes substantially parallel to at least one of the first side surface and the second side surface.

2. The connector plate according to claim 1, further comprising a handle extending from the second side surface.

3. The connector plate according to claim 1, further comprising one or more tabs extending laterally from the second side surface.

4. The connector plate according to claim 1, wherein the flexible zone is flexible about an axis parallel to the first side surface.

5. The connector plate according to claim 1, wherein the opening zone extends in a first plane, and the flexible zone is movable between a first position in which a portion of the flexible zone adjacent the first side surface lies in a second plane that is parallel with the first plane, and a second position in which the portion of the flexible zone adjacent the first side surface lies in a third plane that is oriented relative to the first plane at an exterior (alfa (α)) angle of more than 30 degrees.

6. The connector plate according to claim 1, wherein the opening zone extends in a first plane, and the flexible zone is movable between a first position in which a portion of the flexible zone adjacent the first side surface lies in a second plane that is parallel with the first plane, and a second position in which the portion of the flexible zone adjacent the first side surface lies in a third plane that is oriented relative to the first plane at an exterior (alfa (α)) angle of more than 70 degrees.

7. The connector plate according to claim 1, wherein the opening zone extends in a first plane, and the flexible zone is movable between a first position in which a portion of the flexible zone adjacent the first side surface lies in a second plane that is parallel with the first plane, and a second position in which the portion of the flexible zone adjacent the first side surface lies in a third plane that is oriented relative to the first plane at an exterior (alfa (α)) angle of more than 90 degrees.

8. The connector plate according to claim 1, wherein the flexible zone is movable relative to the opening zone between a first position in which the first side surface is spaced from the second side surface by a first distance, and a second position in which the first side surface is spaced from the second side surface by a second distance, the second distance being 75-90% of the first distance.

9. The connector plate according to claim 8, wherein in the opening zone lies flat in a first plane when the flexible zone is in the first position and the second position.

10. The connector plate according to claim 1, wherein the flexible zone further comprises a living hinge, a perforation, a rib structure, or a flexible material.

11. The connector plate according to claim 1, wherein the first side surface comprises a sensing area configured to interact with a sensor or safety mechanism in a vacuum cleaner.

12. The connector plate according to claim 1, wherein the first side surface comprises at least one hole and/or recess.

13. The connector plate according to claim 1, further comprising a closing mechanism configured to selectively close the opening.

14. The connector plate according to claim 13, wherein the closing mechanism comprises a slidable shutter, a lid or a hatch.

15. A vacuum cleaner dust container comprising:
an air permeable bag having a bag opening; and
a connector plate attached to the air permeable bag, the connector plate comprising:
a front surface having an opening overlying the bag opening;
a first side surface configured to be inserted into a holder of a vacuum cleaner;
a second side surface located opposite the first side surface, the second side surface being closer to the opening than the first side surface;
a third side surface connecting the first and second side surfaces;
a fourth side surface opposite the third side surface and connecting the first and second side surfaces;
a flexible zone between the opening and the first side surface; and
an opening zone between the flexible zone and the second side surface and including the opening therein;
wherein the flexible zone is more flexible than the opening zone; and
wherein the flexible zone comprises one or more perforations or holes substantially parallel to at least one of the first side surface and the second side surface.

16. The vacuum cleaner dust container according to claim 15, further comprising a handle extending from the second side surface.

17. The vacuum cleaner dust container according to claim 15, wherein the opening zone extends in a first plane, and the flexible zone is movable between a first position in which a portion of the flexible zone adjacent the first side surface lies in a second plane that is parallel with the first plane, and a second position in which the portion of the flexible zone adjacent the first side surface lies in a third plane that is oriented relative to the first plane at an exterior (alfa ($\alpha$)) angle of more than 70 degrees.

18. The vacuum cleaner dust container according to claim 15, wherein the flexible zone is movable relative to the opening zone between a first position in which the first side surface is spaced from the second side surface by a first distance, and a second position in which the first side surface is spaced from the second side surface by a second distance, the second distance being 75-90% of the first distance.

19. The vacuum cleaner dust container according to claim 18, wherein in the opening zone lies flat in a first plane when the flexible zone is in the first position and the second position.

20. A connector plate for a vacuum cleaner dust container, the connector plate comprising:
a front surface having an opening for an airflow;
a first side surface configured to be inserted into a holder of a vacuum cleaner;
a second side surface located opposite the first side surface, the second side surface being closer to the opening than the first side surface;
a third side surface connecting the first and second side surfaces;
a fourth side surface opposite the third side surface and connecting the first and second side surfaces;
a flexible zone between the opening and the first side surface; and
an opening zone between the flexible zone and the second side surface and including the opening therein;
wherein the flexible zone is more flexible than the opening zone; and
wherein the first side surface comprises at least one hole and/or recess.

21. The connector plate according to claim 20, wherein the flexible zone is flexible about an axis parallel to the first side surface.

22. The connector plate according to claim 20, wherein the opening zone extends in a first plane, and the flexible zone is movable between a first position in which a portion of the flexible zone adjacent the first side surface lies in a second plane that is parallel with the first plane, and a second position in which the portion of the flexible zone adjacent the first side surface lies in a third plane that is oriented relative to the first plane at an exterior (alfa ($\alpha$)) angle of more than 30 degrees.

23. The connector plate according to claim 20, wherein the flexible zone comprises a living hinge, a perforation, a rib structure, or a flexible material.

24. The connector plate according to claim 20, wherein the flexible zone comprises one or more perforations or holes substantially parallel to the second side surface.

25. The connector plate according to claim 20, wherein the first side surface comprises a sensing area configured to interact with a sensor or safety mechanism in a vacuum cleaner.

26. The connector plate according to claim 20, further comprising a closing mechanism configured to selectively close the opening.

27. A vacuum cleaner dust container comprising:
an air permeable bag having a bag opening; and
a connector plate attached to the air permeable bag, the connector plate comprising:
a front surface having an opening overlying the bag opening;
a first side surface configured to be inserted into a holder of a vacuum cleaner;
a second side surface located opposite the first side surface, the second side surface being closer to the opening than the first side surface;
a third side surface connecting the first and second side surfaces;
a fourth side surface opposite the third side surface and connecting the first and second side surfaces;
a flexible zone between the opening and the first side surface; and
an opening zone between the flexible zone and the second side surface and including the opening therein;
wherein the flexible zone is more flexible than the opening zone; and
wherein the first side surface comprises at least one hole and/or recess.

28. The vacuum cleaner dust container according to claim 27, further comprising a handle extending from the second side surface.

29. The vacuum cleaner dust container according to claim 27, wherein the opening zone extends in a first plane, and the flexible zone is movable between a first position in which a portion of the flexible zone adjacent the first side surface lies in a second plane that is parallel with the first plane, and a second position in which the portion of the flexible zone adjacent the first side surface lies in a third plane that is oriented relative to the first plane at an exterior (alfa ($\alpha$)) angle of more than 70 degrees.

* * * * *